United States Patent [19]

Misumi et al.

[11] 4,279,784

[45] Jul. 21, 1981

[54] THERMIONIC EMISSION CATHODES

[75] Inventors: Akira Misumi; Shunji Saito, both of Mobara, Japan

[73] Assignee: Hitachi, Ltd., Tokyo, Japan

[21] Appl. No.: 972,873

[22] Filed: Dec. 26, 1978

[30] Foreign Application Priority Data

Dec. 26, 1977 [JP] Japan ..... 52-155551

[51] Int. Cl.[3] ..... H01B 1/02

[52] U.S. Cl. ..... 252/513; 252/514; 252/515; 252/517; 252/518; 252/519; 252/520; 313/346 R; 313/346 DC; 29/25.14

[58] Field of Search ..... 252/513, 512, 515, 517, 252/518, 520, 514, 519; 313/346 R, 346 DC; 29/25.14, 25.17

[56] References Cited

U.S. PATENT DOCUMENTS

| | | | |
|---|---|---|---|
| 2,716,716 | 8/1955 | Hughes et al. | 313/346 DC |
| 2,848,644 | 8/1958 | Koppius | 313/346 DC |
| 3,170,772 | 2/1965 | Sato et al. | 313/346 DC |
| 3,500,106 | 3/1970 | Berchtold | 252/515 |
| 3,719,856 | 3/1973 | Koppius | 313/346 DC |
| 3,842,309 | 10/1974 | Stratum et al. | 313/346 DC |
| 3,879,830 | 4/1975 | Buescher | 252/513 |
| 4,083,811 | 4/1978 | Bachmann | 252/515 |
| 4,101,800 | 7/1978 | Thomas et al. | 313/346 DC |
| 4,147,954 | 4/1979 | Tuck | 313/346 DC |

*Primary Examiner*—Benjamin R. Padgett
*Assistant Examiner*—J. L. Barr
*Attorney, Agent, or Firm*—Craig and Antonelli

[57] ABSTRACT

A thermionic emission cathode comprising a base metal made of nickel-tungsten series alloy, for example an alloy comprising 90 to 70% by weight of nickel and 10 to 30% by weight of tungsten, and an emitter layer, which is formed on the base, made from a mixture of (a) tungsten powder or nickel-tungsten alloy powder comprising 90 to 70% by weight of nickel and 10 to 30% by weight of tungsten, (b) $Ba_3WO_6$ powder and (c) zirconium powder or $ZrH_2$ powder, and if necessary interposing a powder layer between the base and the emitter layer, said powder layer having the same composition as the base metal and a particle size of 1 to 10 $\mu$m sealed on the surface of the base with a distribution density of 0.5 to 5.0 mg/cm$^2$, can be applied to both directly and indirectly heated type cathodes. Said cathode has such advantages as being able to be miniaturized and to have high current density.

20 Claims, 3 Drawing Figures

THERMIONIC EMISSION CATHODES

This invention relates to a tungstate cathode which is capable of withstanding high current density and can be constructed in a small size.

Figure 1:
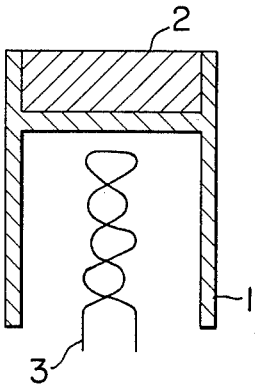
Figure 2:
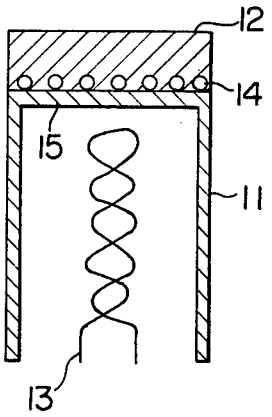
Figure 3:
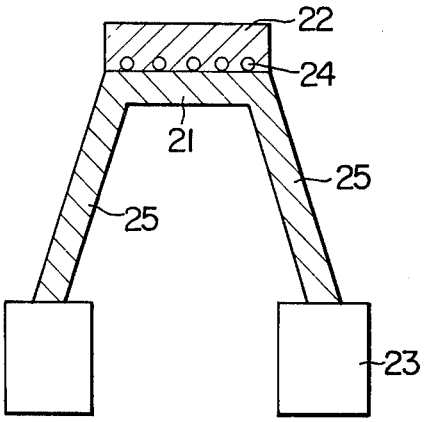

A prior art and the present invention and advantages of the latter will be described in detail with reference to the attached drawings, in which:

FIG. 1 is a sectional view of one example of known indirectly heated tungstate cathodes, FIG. 2 is a sectional view of one example of indirectly heated tungstate cathodes according to the present invention, and FIG. 3 is a sectional view of one example of directly heated tungstate cathodes according to the present invention.

Oxide-coated cathodes having an emitter layer consisting of (Ba, Sr, Ca)O or (Ba, Sr)O on a base metal plate made of Ni or Ni with a very small amount of reductive activating agent such as Mg or the like have widely been used for usual electron tubes. This is because the oxide-coated cathodes have good thermionic emission efficiency and proper electron emission can be obtained at such a low operation temperature as 700° $C._B$–850° $C._B$ (hereinafter a luminance temperature is referred to as "$C_B$"), and moreover miniaturization is possible due to easy machining of the base metal.

Heretofore, the oxide-coated cathodes have generally been used for cathode-ray tubes such as a television picture tube. But recently, a desire for cathode-ray tubes having high resolution has become stronger, which resulted in the requirement for electron beams finer than conventional ones at the same or higher electric current value, i.e. electron beams at high current density. This desire finally requires that a cathode for a cathode-ray tube also emits electrons at high current density. On the other hand, the oxide-coated cathode is not suitable for emitting electrons at high current density and if it is forced to emit electrons at high current density, it will be broken due to its overload. Thereafter, if a high current density is necessary, there have been used a tungstate cathode, a monoatomic layer cathode made of tungsten and 1–2% by weight of $ThO_2$, an L-cathode having a coating of (Ba, Sr)O on a molybdenum base and a porous tungsten cover covering the coating, and the like. But all of these cathodes have low thermionic emission efficiency and cannot show the property of emitting electrons at high current density unless operated at a high temperature of 1100° $C._B$–2300° $C._B$. Further, these cathodes use high melting point metals such as tungsten and molybdenum as a base in order to be bearable during operations at high temperatures, which results in poor machinability and difficulty in miniaturization. Therefore, these cathodes have no interchangeability with oxide-coated cathodes and can only be operated at high temperatures. Thus, it is very difficult to apply the high current density cathodes mentioned above to cathode-ray tubes.

As cathodes capable of withstanding high current density and having relatively low operating temperatures, tungstate cathodes have been studied. FIG. 1 is a sectional view of a conventional indirectly heated tungstate cathode. A base 1 made of molybdenum has a cylindrical form and at the upper portion of the cylinder there is a cup-like reentrant portion in which an emitter layer 2 consisting of a sintered material produced from a mixture of tungsten powder, $Ba_3WO_6$ powder and zirconium powder is housed, said emitter layer 2 being put to use by heating with a heater 3 to 600° $C._B$–1100° $C._B$. From the viewpoint of operating temperature, the tungstate cathode has interchangeability with the oxide-coated cathode, but miniaturization of the base 1 made of molybdenum is very difficult. Consequently, it is difficult to apply the tungstate cathode to cathode-ray tube, for example, a television picture tube.

As to tungstate cathodes and electron emission therefrom, there are many articles reporting experimental results such as IEEE Conference Record of 1968, Ninth Conference on Tube Techniques, pp. 29–40, M. J. Slivka: "Effects of Composition and Processing on Emission and Life Characteristics of Tungstate Matrix Cathodes"; IEEE Transactions on Electro Devices, 1977, pp. 279–281, B. Smith and A. Newman: "Pulse Emission and Extended Life Testing of the Tungstate Cathode".

It is an object of the present invention to provide a thermionic emission cathode capable of emitting electrons at high current density which has a relatively low operating temperature, uses an easily workable base metal, and is able to be miniaturized and also able to be used in place of an oxide-coated cathode in a cathode-ray tube and the like.

The present invention provides a thermionic emission cathode which comprises a base having a flat portion at the top of it and made of a nickel-tungsten series alloy containing nickel as a main component, and an emitter layer, which is formed on the flat portion of the base, made from a mixture of (a) tungsten powder or nickel-tungsten alloy powder comprising 90 to 70% by weight of nickel and 10 to 30% by weight of tunsgten, (b) $Ba_3WO_6$ powder and (c) zirconium powder or $ZrH_2$ powder.

The present invention also provides a thermionic emission cathode which has a powder layer having the same composition as the base metal alloy and a particle size of 1 to 10 $\mu$m and sealed to the base metal with a distribution density of 0.5 to 5.0 mg/cm$^2$ between the base and the emitter layer.

The present invention is explained in more detail with reference to FIG. 2. In FIG. 2, numeral 11 denotes a cylindrical base having a circular flat portion at the top of it, numeral 12 denotes an emitter layer, numeral 13 denotes a heater, and numeral 14 denotes a powder layer.

The base 11 is made of a nickel-tungsten series alloy containing nickel as a main component and preferably 10 to 30% by weight of tungsten. The base metal alloy may further contain a small amount of one or more reducing agents such as Zr, Mg, Si, Al, U, Th, and the like on the order of impurity amount or more. Further a part of the tungsten may be replaced by Mo or/and Re, so long as the tungsten content is not reduced to less than 5% by weight and the total of tungsten and Mo or/and Re is in the range of 10% to 30% by weight.

Since the tungstate cathode of the present invention uses the Ni-W series alloy comprising preferably 10 to 30% by weight of tungsten and the remainder being nickel as the base metal unlike a known tungstate cathode using molybdenum, which is difficult in working, as the base metal, press working and thin plate working can be carried out easily and consequently the miniaturization becomes possible. Further, with the change of the kind of base metal, the cup-like reentrant portion in which an emitter layer is housed and which is formed on the base made of molybdenum according to the known tungstate cathode as shown in FIG. 1 is changed to the flat circular portion (or plate). The flat circular portion 15, as shown in FIG. 2, is disposed at the top of the cylinder to form the base 11, to which the emitter layer 12 is bonded directly or by interposing the powder layer 14 of Ni-W series alloy having the same composition as the base metal.

The base metal made of the Ni-W series alloy e.g. comprising 90 to 70% by weight of nickel and 10 to 30% by weight of tungsten, has by far higher malleability than molybdenum, so that the form as shown in FIG. 2 can be obtained by press work. If the amount of tungsten is less than 10% by weight, mechanical strength at high temperatures becomes insufficient, whereas if the amount of tungsten is more then 30% by weight, the desired workability cannot be obtained. There is no difference in electron emission property comparing with the base metal made of molybdenum. Further since the Ni-W series alloy mentioned above has good workability as mentioned above, miniaturization of the base is possible. The cylindrical base metal plate 11 as shown in FIG. 2 has no cup-like reentrant portion as shown in FIG. 1 in the case of the conventional tungstate cathode the base 1 of which is made of molybdenum. Thus the tungstate cathode of the present invention can be considerably miniaturized. Even if the base metal plate 11 has no rising portion around the periphery of the emitter layer, sufficient bonding of the emitter layer to the surface of base metal can be obtained by a coventional method, for example, making the surface of base metal coarse.

The emitter layer is formed from a mixture of (a) tungsten powder or nickel-tungsten alloy powder comprising 90 to 70% by weight of nickel and 10 to 30% by weight of tungsten, (b) $Ba_3WO_6$ powder and (c) zirconium powder or $ZrH_2$ powder by sintering. For example, the emitter layer 12 is a sintered mixture obtained from a composition preferably having 88 to 90% by weight of tungsten powder, 7.5 to 11% by weight of $Ba_3WO_6$ powder and 0.5 to 1.8% by weight of zirconium powder. The tungsten powder can be replaced by Ni-W alloy powder comprising 90 to 70% by weight of Ni and 10 to 30% by weight of W. The zirconium powder can be replace by $ZrH_2$ powder advantageously, since $ZrH_2$ is more stable and less oxidizable than Zr elementary substance during the storage in the air and can generate $H_2$ to make the circumstances reductive during the heat treatment. When the tungsten powder is replaced by the Ni-W alloy powder consisting of 90 to 70% by weight of Ni and 10 to 30% by weight of W, adhesive strength between the emitter layer and the base metal can be enhanced without influencing the electron emission property.

In the composition for forming the emitter layer, there are usually used $Ba_3WO_6$ powder having a particle size of 1 to 10 μm, Zr or $ZrH_2$ powder having a particle size of 1 to 3 μm, W powder having a particle size of 5 to 10 μm, and Ni-W alloy powder having a particle size of 1 to 5 μm. The particle size of each powder only slightly influences an initial emission current and does not influence the long life property of the cathode.

The emitter layer can be formed on the flat portion of the base, for example, as follows. A mixture containing the components (a), (b) and (c) mentioned above, nitrocellulose and an organic solvent is coated on the base by spraying or printing. The base thus treated is installed in a glass tube, which is evacuated by using a conventional process and a very high vacuum is obtained by using flash getters. Subsequently, sintering, activation and ageing of the emitter layer are conducted with heating by applying an electric current. The sintering and activation are conducted at 1100° $C._B$ for 10 minutes and ageing at 1000° $C._B$ for 1 hour.

When the cathode is to be used under severe conditions, a Ni-W alloy powder having the same composition as the base metal having a special particle size is sealed strongly to the base with a special distribution density to form the powder layer between the base and the emitter layer in order to enhance the adhesive strength between the base and the emitter layer without influencing the thermionic emission property. That is, as shown in FIG. 2, the alloy powder having a particle size of 1 to 10 μm and the same composition as the base metal is spread over the surface of the flat portion 15 of the base 11 with a distribution density of 0.5 to 5.0 $mg/cm^2$ to form the powder layer 14 sealed to the base metal and the emitter layer 12 is also sealed strongly to the base metal 11 through the powder layer 14. The powder layer 14 can easily be formed by spreading the above-mentioned alloy powder on the surface of the flat portion 15 of the base and heating under vacuum or in the atmosphere of hydrogen at 700° C. to 1000° C., preferably about 1000° C. The powder layer 14 interposed between the emitter layer 12 and the base 11 hardly influences the thermionic emission property.

Peeling of the emitter layer from the base is influenced by not only the distribution density of the powder layer but also particle sizes of the powder of the emitter layer and of the Ni-W alloy powder. The greatest effect of prevention of peeling of the emitter layer was observed at the coverage of 60 to 80% on the surface of the base with the alloy powder. According to the present inventions' experiments, such a coverage corresponds to a distribution density of 0.5 to 5.0 $mg/cm^2$. If the density is larger than 5.0 $mg/cm^2$, the effect decreases and a heat capacity of the cathode rather increases with disadvantageous results. If the purpose is only for preventing the peeling of emitter layer, it is not necessary to use the Ni-W alloy powder having the same composition as the base metal for forming the powder layer. Only Ni powder and W powder can be used instead thereof. But if Ni powder or W powder is used, there takes place mutual diffusion between the base metal and the powder layer during the operation of the thermionic cathode at high temperatures and deformation of the base also occurs. Therefore the powder layer 14 should be formed by using the same alloy powder as the base metal alloy.

In case of using the cathode under more sever conditions wherein slight deformation of the base is not allowable, it is advisable to form the emitter layer from a mixture of (a) Ni-W alloy powder having the same composition as the base metal alloy in place of W powder, (b) $Ba_3WO_6$ powder and (c) Zr powder. Deformation of the base during the usage of the cathode can be lessened markedly by the same reason as mentioned above, and this effect becomes more and more remarkably when the size of the cathode becomes smaller and smaller. Further, even if W powder is replaced by Ni-W alloy powder, there is no change in the amount of thermionic emission and sputtering of Ni is such a small degree as not to produce any problem.

The thermionic emisssion cathodes of the present invention, irrespective of the presence of the powder layer 14 between the emitter layer 12 and the base 11 in FIG. 2 or irrespective of the component (a) of the emitter layer, i.e. whether W powder or Ni-W alloy powder is used, were able to maintain electron emission of 0.2 $A/cm^2$ at 730° $C._B$ for 40,000 hours and of 0.5 $A/cm^2$ at 780° $C._B$ for 46,000 hours. These results are remarkably excellent comparing with a conventional oxide-coated cathode in which the initial value of electron emission of 0.4 $A/cm^2$ is deteriorated to 60% thereof after operating for 10,000 hours.

The cathode of the present invention has been explained as to the indirectly heated type cathode referring to FIG. 2 for easy comparison with the conventional tungstate cathode as shown in FIG. 1, but the application of the cathode of the present invention is not limited to indirectly heated type cathodes, and the cathode of the present invention can also be applied to so-called directly heated type cathodes as shown in FIG. 3, which are operated by flowing a current through a base via terminals 23 which are connected to an electric power supply not shown in the drawing in order to heat it to a desired temperature. In FIG. 3, numeral 22 denotes an emitter layer, numeral 24 denotes a powder layer, numeral 25 denotes a leg portions of the base, and numeral 21 denotes a flat portion of the base. Since the Ni-W alloy comprising 90 to 70% by weight of Ni and 10 to 30% by weight of W has relatively high specific resistance and excellent mechanical strength at high temperatures, it is also suitable for the base metal of direactly heated type cathodes. The cathode of the present invention can be used not only for cathode-ray tubes but also for small-sized high current density cathodes widely.

An explained above, according to the present invention, cathodes capable of emitting electrons at high current density can be provided, said cathodes being able to be used for an application where a small-sized cathode is necessarily used and hence an oxide-coated cathode is conventionally employed.

What is claimed is:

1. A thermionic emission cathode which comprises a base made of a nickel-tungsten series alloy comprising 90 to 70% by weight of nickel and 10 to 30% by weight of tungsten, and an emitter layer, which is formed on the base and which is made from a mixture of (a) tungsten powder or nickel-tungsten alloy powder, (b) $Ba_3WO_6$ powder and (c) zirconium powder or $ZrH_2$ powder.

2. A thermionic emission cathode according to claim 1, wherein the base is made of an alloy comprising 10 to 30% by weight of tungsten, a small amount of at least one reducing agent selected from the group consisting of Zr, Mg, Si, Al, U and Th, and the remainder being nickel.

3. A thermionic emission cathode according to claim 1, wherein the base is made of an alloy comprising 10 to 30% by weight of tungsten and molybdenum or/and rhenium, tungsten being 5% by weight or more, a small amount of at least one reducing agent selected from the group consisting of Zr, Mg, Si, Al, U and Th, and the remainder being nickel.

4. A thermionic emission cathode according to claim 1, wherein the component (a) in the emitter layer is nickel-tungsten alloy powder comprising 90 to 70% by weight of nickel and 10 to 30% by weight of tungsten.

5. A thermionic emission cathode according to claim 1, wherein the component (a) in the emitter layer is tungsten powder.

6. A thermionic emission cathode according to claim 1, 2, or 3, wherein the emitter layer is made from a mixture of (a) tungsten powder, (b) $Ba_3WO_6$ powder and (c) zirconium powder.

7. A thermionic emission cathode according to claim 1, 2, or 3, wherein the emitter layer is made from a mixture of (a) nickel-tungsten alloy powder comprising 90 to 70% by weight of nickel and 10 to 30% by weight of tungsten, (b) $Ba_3WO_6$ powder and (c) zirconium powder.

8. A thermionic emission cathode according to claim 1, 2, or 3, which further comprises a powder layer between the base and the emitter layer by sealing nickel-tungsten alloy powder having the same composition as the base metal and a particle size of 1 to 10 μm on the surface of base with a distribution density of 0.5 to 5.0 $mg/cm^2$.

9. A thermionic emission cathode according to claim 8, wherein the component (a) in the emitter layer is nickel-alloy powder having the same composition as the base metal.

10. A thermionic emission cathode according to claim 8, wherein the component (a) in the emitter layer is tungsten powder.

11. A thermionic emission cathode according to claim 8, wherein the emitter layer is made from a mixture of (a) tungsten powder, (b) $Ba_3WO_6$ powder and (c) zirconium powder.

12. A thermionic emission cathode according to claim 8, wherein the emitter layer is made from a mixture of (a) nickel-tungsten alloy powder comprising 90 to 70% by weight of nickel and 10 to 30% by weight of tungsten, (b) $Ba_3WO_6$ powder and (c) zirconium powder.

13. A thermionic emission cathode according to claims 1, wherein the emitter layer is made from a mixture of (a) 88 to 90% by weight of tungsten powder, (b) 7.5 to 11% by weight of $Ba_3WO_6$ powder and (c) 0.5 to 1.8% by weight of zirconium powder.

14. A thermionic emission cathode according to claims 1, 2 or 3, said cathode further comprises a heater for heating said base and said emitter layer.

15. A thermionic emission cathode according to claim 8, said cathode further comprises a heater for heating said base and said emitter layer.

16. A thermionic emission cathode according to claims 1, 2 or 3, wherein said base having terminals connected to an electric power supply.

17. A thermionic emission cathode according to claim 8, wherein said base having terminals connected to an electric power supply.

18. A process for producing a thermionic emission cathode which comprises forming a base having a cylindrical or polygonal prism form and having a flat portion at the top thereof by using an alloy of nickel-tungsten series comprising 90 to 70% by weight of nickel and 10 to 30% by weight of tungsten, coating a mixture of (a) tungsten powder or nickel-tungsten alloy powder comprising 90 to 70% by weight of nickel and 10 to 30% by weight of tungsten, (b) $Ba_3WO_6$ powder and (c) zirconium powder or $ZrH_2$ powder, on the base, and sintering at a temperature of from 700° C. to 1000° C. under vacuum or in hydrogen gas to form an emitter layer.

19. A process according to claim 18, which further comprises forming a powder layer between the base and the emitter layer by sealing nickel-tungsten alloy powder having the same composition as the base metal alloy and a particle size of 1 to 10 μm on the surface of the base with a distribution density of 0.5 to 5.0 mg/cm$^2$.

20. A thermionic emission cathode according to claim 1, wherein the emitter layer is made from a mixture of (a) 88 to 90% by weight of a nickel-tungsten alloy comprising 90 to 70% by weight of nickel and 10 to 33% by weight of tungsten, (b) 7.5 to 11% by weight of $Ba_2WO_6$ powder, and (c) 0.5 to 1.8% by weight of zirconium powder.

* * * * *